US009341441B2

(12) United States Patent
Cheng et al.

(10) Patent No.: US 9,341,441 B2
(45) Date of Patent: May 17, 2016

(54) KEYMOD QUICK MOUNTING ARRANGEMENT

(71) Applicants: Carson Cheng, City of Industry, CA (US); Changan Tian, City of Industry, CA (US)

(72) Inventors: Carson Cheng, City of Industry, CA (US); Changan Tian, City of Industry, CA (US)

(73) Assignee: NC STAR, INC., City of Industry, CA (US)

( * ) Notice: Subject to any disclaimer, the term of this patent is extended or adjusted under 35 U.S.C. 154(b) by 0 days.

(21) Appl. No.: 14/218,893

(22) Filed: Mar. 18, 2014

(65) Prior Publication Data

US 2015/0267993 A1 Sep. 24, 2015

(51) Int. Cl.
*F41C 27/00* (2006.01)
*F41G 11/00* (2006.01)

(52) U.S. Cl.
CPC ..... *F41C 27/00* (2013.01); *F41G 11/001* (2013.01); *F41G 11/004* (2013.01)

(58) Field of Classification Search
CPC ..... A45F 5/02; A45F 2005/025; A45F 2005/026; F41G 11/001; F41G 11/004; F41G 11/005; F41G 11/006; F41G 11/007; F41G 11/008; F41C 27/00
USPC ..... 42/124, 127, 148; 224/197, 198, 199
See application file for complete search history.

(56) References Cited

U.S. PATENT DOCUMENTS

| | | | | |
|---|---|---|---|---|
| 2,326,558 | A * | 8/1943 | Pelz | 24/3.11 |
| 3,910,469 | A * | 10/1975 | Baldocchi | 224/198 |
| 2006/0010758 | A1* | 1/2006 | Zeh | F41G 11/001 42/124 |
| 2006/0283070 | A1* | 12/2006 | Murello | F41G 11/007 42/127 |
| 2012/0141050 | A1* | 6/2012 | Moreau et al. | 383/109 |

* cited by examiner

*Primary Examiner* — Stephen M Johnson
(74) *Attorney, Agent, or Firm* — Raymond Y. Chan; David and Raymond Patent Firm

(57) ABSTRACT

A KeyMod quick mounting arrangement is arranged for detachably coupling an accessory at a firearm having a KeyMod mounting slot, wherein the arrangement includes a mounting body having a first side extended from the accessory to be detachably coupled with the firearm, and a coupling head movably extended from the mounting body between a releasing position and a securing position. The coupling head has a head portion outwardly protruded from an opposed second side of the mounting body, wherein the mounting body is stationary when the coupling head is moved between the releasing position and the securing position. In the releasing position, the head portion of the coupling head is disposed in an enlarged slot portion of the mounting slot. In the securing position, the head portion of the coupling head is slid to a narrower slot portion of the mounting slot for securing the accessory at the firearm.

2 Claims, 14 Drawing Sheets

KEYMOD QUICK MOUNTING ARRANGEMENT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a firearm accessory attachment system of a firearm, and more particular to a KeyMod quick mounting arrangement, which provides a quick and precise attachment for a firearm accessory to be detachably mounted at the firearm.

2. Description of Related Arts

Conventional accessory mounts, such as "Picatinny rail system or "Weaver" rail system, have evolved in the firearm industry from a military standard. The conventional accessory mount generally provides a rail comprising a plurality of T-shaped cross sectional raised ridges formed at the firearm, and an adapter provided at the accessory, wherein the accessory can be mounted at the rail by transversely sliding the adapter at the rail and fastening the adapter at the rail via a bolt. However, the conventional accessory mount has several drawbacks. The rail will only enable the accessory to be mounted at the firearm at the transverse direction. It is not ergonomic for a user to hold the firearm and mount the accessory to the rail in a transverse direction to the discharge axis of the firearm. In addition, the rail profile with the raised ridges will substantially increase the overall weight of the firearm. More importantly, the rail cannot provide a quick and precise attachment for the firearm because the adapter must be fastened with the rail by the bolt.

A "KeyMod" mounting arrangement is an improved system superior to the conventional accessory mount. The KeyMod mounting arrangement generally comprises to a plurality of KeyMod mounting slots provided at the firearm and a KeyMod mounting nut provided at the accessory. In particular, each of the mounting slots, which is extended along the discharge axis of the firearm, has a keyhole configuration defining an enlarged slot portion with larger diameter and a narrower slot portion extended therefrom, wherein the slot is chamfered on the backside. Therefore, the mounting nut can be disposed in the enlarged slot portion and slid to the narrower slot portion. Then, the mounting nut can be fastened at the narrower slot portion by a bolt to lift the mounting nut at the backside of the mounting slot in order to secure the accessory at the firearm. The KeyMod mounting arrangement can solve the existing problems by providing an ergonomic mounting way to mount the accessory at the firearm corresponding to the discharge axis thereof, and by substantially reducing the overall weight of the firearm incorporating with the KeyMod mounting slots. However, the KeyMod mounting arrangement has several drawbacks.

The alignment between the mounting nut and the enlarged slot portion of the mounting slot must be precise. Especially when two or more mounting nuts are provided at the accessory, the user must correctly align the mounting nuts with the enlarged slot portions of the mounting slots respectively. Since the mounting nuts are movable, the user must hold the mounting nuts stationary before the mounting nuts are plugged into the enlarged slot portions of the mounting slots. It is worth mentioning that the mounting nuts can only be stationary or locked after the mounting nuts are lifted by the bolts to couple at the narrower slot portions of the mounting slots. In other words, the KeyMod mounting arrangement provides a displeasing mounting operation comparing with the conventional "Picatinny rail system or "Weaver" rail system. Furthermore, the KeyMod mounting arrangement still cannot provide a quick and precise attachment for the firearm because the mounting nut must be fastened with the mounting slot by the bolt.

SUMMARY OF THE PRESENT INVENTION

The invention is advantageous in that it provides a KeyMod quick mounting arrangement, which provides a quick and precise attachment for a firearm accessory to be detachably mounted at the firearm.

Another advantage of the invention is to a KeyMod quick mounting arrangement, which can incorporate an existing KeyMod slot rail to mount the accessory, such as laser module, scope mount, flashlight module, navigation light module, camera module, vertical grip, rail panel, hand stop, barricade support, at the firearm. In other words, the KeyMod quick mounting arrangement does not require to alter the original structural design of the KeyMod mounting structure of the firearm, so as to minimize the manufacturing cost of the KeyMod mounting structure of the firearm incorporating with the KeyMod quick mounting arrangement.

Another advantage of the invention is to a KeyMod quick mounting arrangement, which comprises a coupling head being slid and lifted in one single action to secure the accessory at the firearm.

Another advantage of the invention is to a KeyMod quick mounting arrangement, wherein the coupling head is stationary and locked in a releasing position and in a securing position, such that the coupling head can be precisely and rapidly plugged into the enlarged slot portion of the KeyMod slot to enhance the mounting operation of the accessory at the firearm.

Another advantage of the invention is to a KeyMod quick mounting arrangement, which comprises at least one positioning member arranged to engage with a second KeyMod slot adjacent to the KeyMod slot where the coupling head is coupled thereat, so as to ensure the corrected alignment between the accessory and the firearm and to prevent any unwanted longitudinal and/or rotational movement of the accessory with respect to the firearm after the KeyMod quick mounting arrangement is mounted to the firearm.

Another advantage of the invention is to a KeyMod quick mounting arrangement, wherein the user does not require any tool to fasten and secure the coupling head at the mounting slot, such that the KeyMod quick mounting arrangement provides a tool-less mounting system to speed up the mounting operation of the accessory at the firearm.

Another advantage of the invention is to provide a KeyMod quick mounting arrangement, wherein no expensive or complicated structure is required to employ in the present invention in order to achieve the above mentioned objects. Therefore, the present invention successfully provides an economic and efficient solution for providing a secure and reliable configuration for detachably mounting the accessory at the firearm with compact and ergonomic design.

Additional advantages and features of the invention will become apparent from the description which follows, and may be realized by means of the instrumentalities and combinations particular point out in the appended claims.

According to the present invention, the foregoing and other objects and advantages are attained by a KeyMod quick mounting arrangement for detachably coupling an accessory at a firearm having one or more KeyMod mounting slots, comprising:

a mounting body having a first side adapted for extending from the accessory to be detachably coupled with the firearm, and an opposed second side; and a coupling head, which is movably extended from the mounting body between a releasing position and a securing position, having a head portion outwardly protruded from the second side of the mounting body, wherein the mounting body is stationary when the coupling head is moved between the releasing position and the securing position, wherein in the releasing position, the head portion of the coupling head is arranged for being disposed in an enlarged slot portion of the mounting slot, and in the securing position, the head portion of the coupling head is arranged for being slid to a narrower slot portion of the mounting slot for securing the accessory at the firearm.

In accordance with another aspect of the invention, the present invention comprises a KeyMod quick mounting arrangement, for detachably coupling an accessory at a firearm having one or more KeyMod mounting slots, comprising:

a mounting body having a first side adapted for extending from the accessory to be detachably coupled with the firearm, and an opposed second side;

a coupling head, which is movably extended from the mounting body between a releasing position and a securing position, having a head portion outwardly protruded from the second side of the mounting body; and an actuating member movably coupled at the mounting body to move the coupling head between the releasing position and the securing position, wherein in the releasing position, the head portion of the coupling head is arranged for being disposed in an enlarged slot portion of the mounting slot, and in the securing position, the head portion of the coupling head is arranged for being slid to a narrower slot portion of the mounting slot and for being moved toward the second side of the mounting head at the same time for securing the accessory at the firearm.

In accordance with another aspect of the invention, the present invention comprises a KeyMod quick mounting arrangement, for detachably coupling an accessory at a firearm having one or more KeyMod mounting slots, comprising:

a mounting body having a first side adapted for extending from the accessory to be detachably coupled with the firearm, and an opposed second side;

a coupling head, which is movably extended from the mounting body between a releasing position and a securing position, having a head portion outwardly protruded from the second side of the mounting body; and a locker unit provided at the mounting body for locking the coupling head in the releasing position and in the securing position, wherein in the releasing position, the head portion of the coupling head is locked in position for being disposed in an enlarged slot portion of the mounting slot, wherein after the locker unit is actuated to release the coupling head in the releasing position, the coupling head is moved to the securing position that the head portion of the coupling head is arranged for being slid to a narrower slot portion of the mounting slot for securing the accessory at the firearm.

In accordance with another aspect of the invention, the present invention comprises a KeyMod quick mounting arrangement, for detachably coupling an accessory at a firearm having a plurality of KeyMod mounting slots, comprising:

a mounting body having a first side adapted for extending from the accessory to be detachably coupled with the firearm, and an opposed second side;

a coupling head, which is movably extended from the mounting body between a releasing position and a securing position, having a head portion outwardly protruded from the second side of the mounting body, wherein in the releasing position, the head portion of the coupling head is arranged for being disposed in an enlarged slot portion of the mounting slot, and in the securing position, the head portion of the coupling head is arranged for being slid to a narrower slot portion of the mounting slot for securing the accessory at the firearm; and a positioning member protruded from the second side of the mounting body at a position adjacent to the coupling head, wherein the positioning member is arranged for engaging with a second mounting slot adjacent to the mounting slot where the coupling head is engaged therewith.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 3:
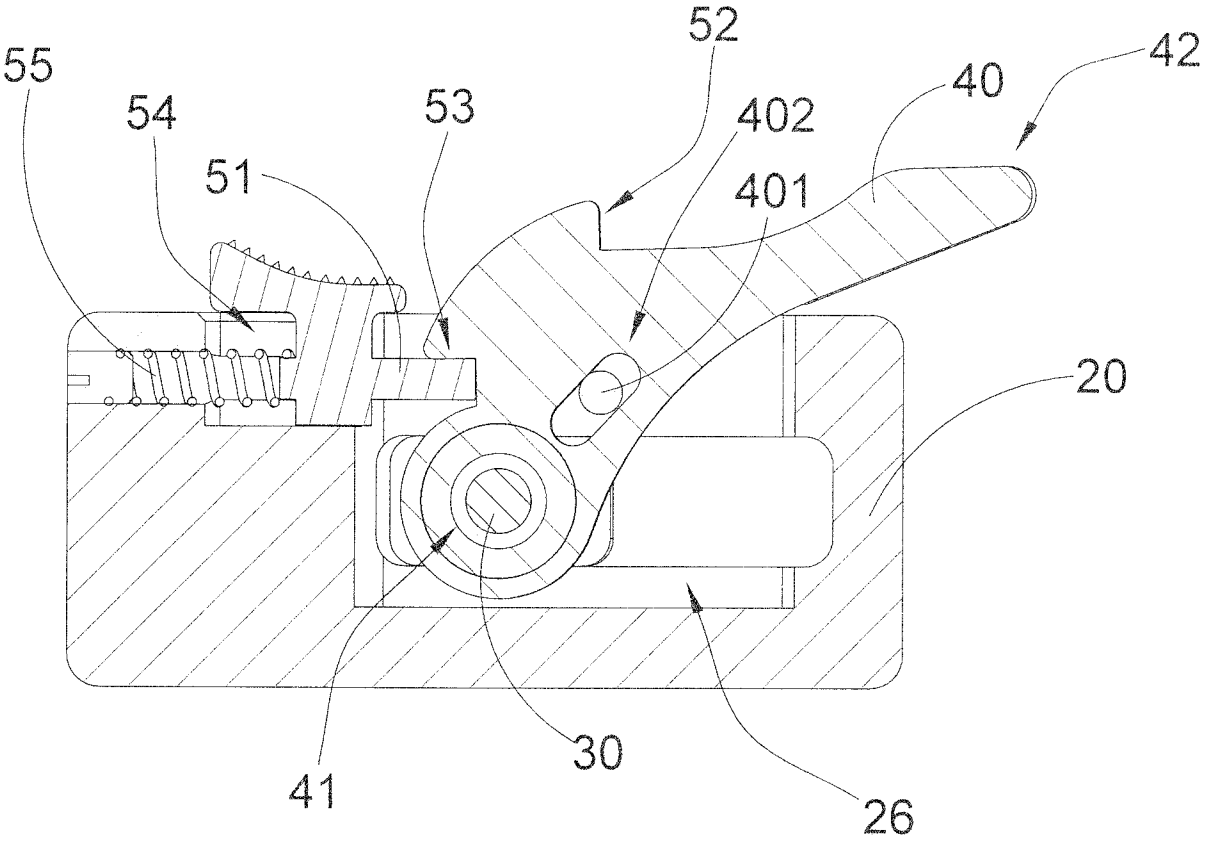
FIG. 3 is a bottom view of the KeyMod quick mounting arrangement according to the above preferred embodiment of the present invention, illustrating the coupling head in a securing position.
Figure 4:
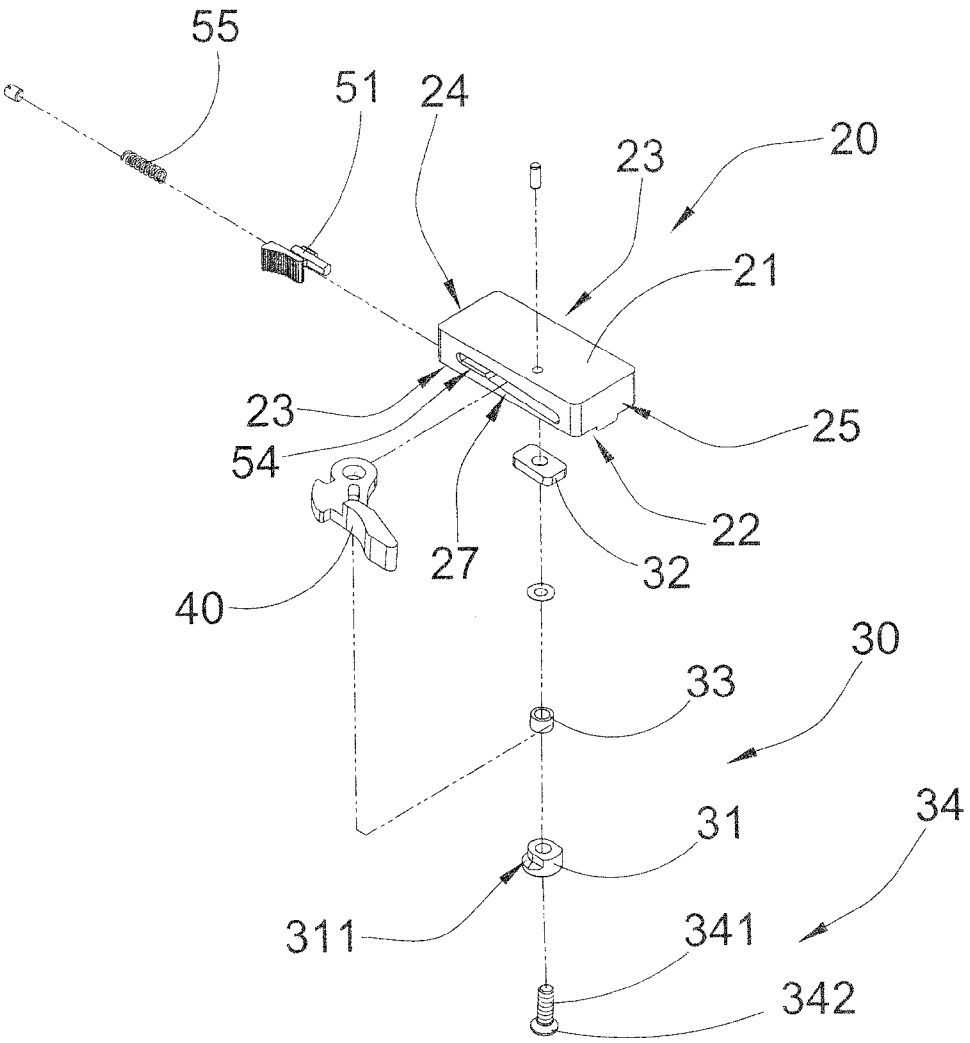
FIG. 4 is an exploded perspective view of the KeyMod quick mounting arrangement according to the above preferred embodiment of the present invention.
Figure 5:
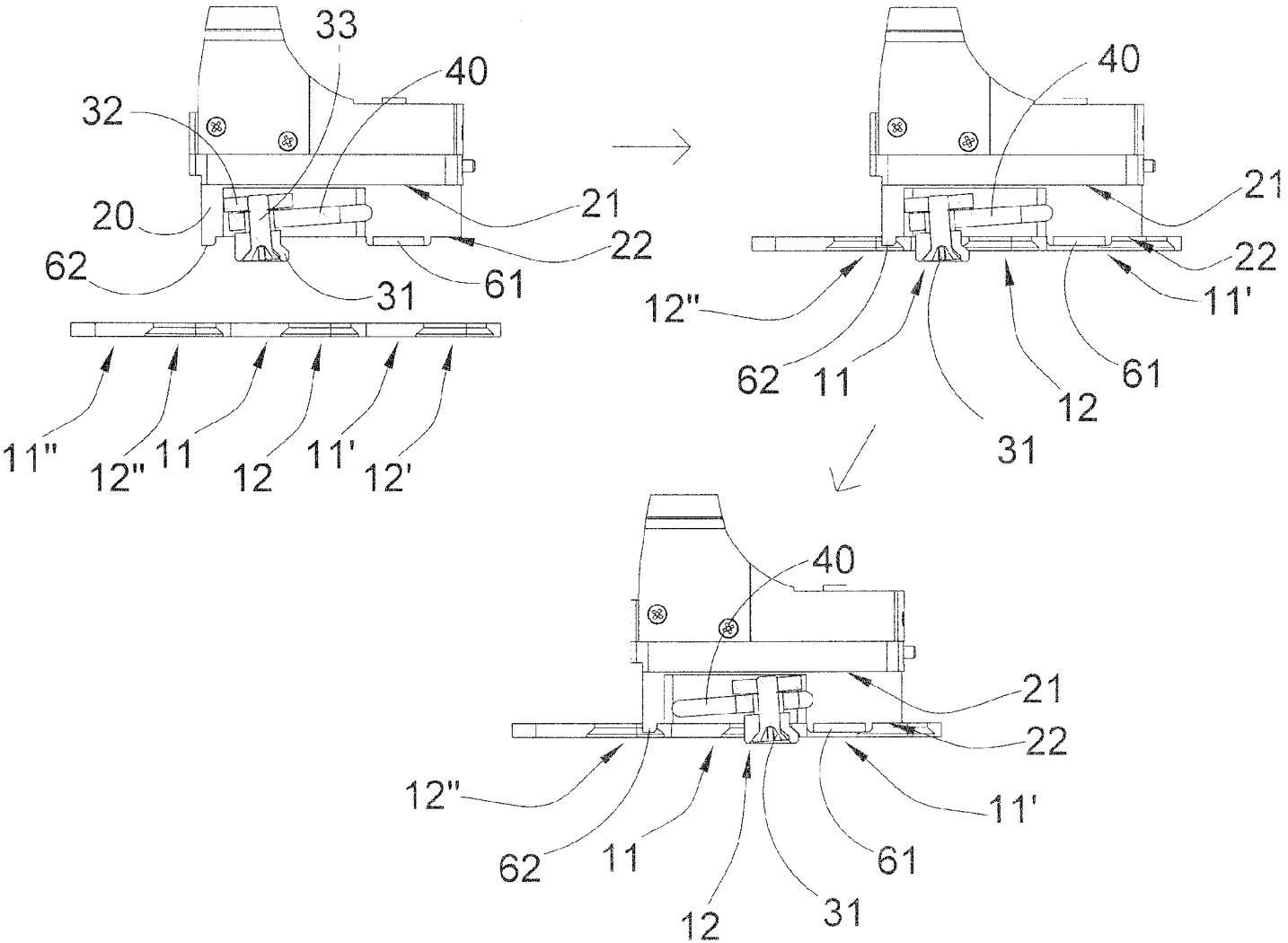
FIG. 5 is a side sectional view of the KeyMod quick mounting arrangement according to the above preferred embodiment of the present invention, illustrating the mounting operation of the arrangement to the KeyMod mounting slot and illustrating the accessory to be detachably mounted at the firearm via the arrangement.

Referring to FIGS. 1 to 7, a KeyMod quick mounting arrangement according to a preferred embodiment of the present invention is illustrated, wherein the arrangement of the present invention is arranged for detachably coupling an accessory at a firearm having one or more KeyMod mounting slots 10. For example, a micro-dot module is provided on the arrangement to detachably couple at the firearm as shown in FIG. 5.

For example, the firearm with a handguard provides a series of KeyMod mounting slots 10 aligning with a barrel axis of the firearm, wherein each of the mounting slots 10 has a Keyhole configuration to define an enlarged slot portion 11 and a narrower slot portion 12. The accessory, such as laser module, scope mount, flashlight module, navigation light module, camera module, vertical grip, rail panel, hand stop, barricade support, can be detachably coupled at the firearm via the arrangement of the present invention.

According to the preferred embodiment, the arrangement of the present invention comprises a mounting body 20 and a coupling head 30.

The mounting body 20 has a first side 21 arranged for extending from the accessory to be detachably coupled with the firearm, and an opposed second side 22 for coupling with the firearm at the mounting slot 10 via the coupling head 30. The mounting body 20 further has two sidewalls 23, a front side 24, and a rear side 25 to define an interior cavity therewithin, and forms a low profile configuration to minimize a distance between the first and second sides 21, 22 so as to minimize the distance between the accessory and the firearm. As shown in FIG. 5, the micro-dot module, as an example, is provided on the first side 21 of the mounting body 20.

The coupling head 30 is movably extended from the mounting body 10 and is moved between a releasing position and a securing position. In particular, the coupling head 30 has a head portion 31 outwardly protruded from the second side 22 of the mounting body 22, a retention portion 32 received in the interior cavity of the mounting body 22, and a neck portion 33 extended between the head portion 31 and the retention portion 32. The coupling head 30 further has a slanted engaging surface 311 formed at the head portion 31 to the mounting slot 10 with a chamfered configuration.

The coupling head 30 further comprises a head adjustor 34 for adjusting a distance between the head portion 31 and the retention portion 32. The head adjustor 34 comprises a threaded body 341 rotatably coupled at the retention portion 32 and an enlarged adjuster head 342 coupled at the head portion 31, such that when the head adjustor 34 is rotated, the threaded body 341 rotated at the retention portion 32 to selectively adjust the distance between the head portion 31 and the retention portion 32. Therefore, a portion of the threaded body 341 serves the neck portion 32 of the coupling head 30.

Accordingly, in the releasing position, the head portion 31 of the coupling head 30 is arranged for being disposed in the enlarged slot portion 11 of the mounting slot 10, and in the securing position, the head portion 31 of the coupling head 30 is arranged for being slid to the narrower slot portion 12 of the mounting slot 10 for securing the accessory at the firearm. In other words, the head portion 31 of the coupling head 30 is slid from the enlarged slot portion 11 of the mounting slot 10 to the narrower slot portion 12 thereof in order to couple the mounting body 20 at the firearm, so as to support the accessory at the firearm.

According to the preferred embodiment, the mounting body 20 is stationary when the coupling head 30 is moved between the releasing position and the securing position. In other words, after the head portion 31 of the coupling head 30 is disposed at the enlarged slot portion 11 of the mounting slot 10, only the coupling head 30 is moved to slide the head portion 31 of the coupling head 30 to the narrower slot portion 12 of the mounting slot 10. Therefore, the mounting body 20 is stationary during the sliding movement of the coupling head 30.

In order to enable the sliding movement of the coupling head 30 when the mounting body 20 is stationary, the mounting body 20 further has an elongated guiding slot 26 formed at the second side 22 of the mounting body 20. The coupling head 30 is slidably engaged at the guiding slot 26 in a position that the neck portion 33 of the coupling head 30 is slid along the guiding slot 26, such that the head portion 31 of the coupling head 30 is outwardly protruded from the second side 22 of the mounting body 20 through the guiding slot 26 and is guided to slide at the guiding slot 26 between the releasing position and the securing position.

The guiding slot 26 is a through slot longitudinally formed at the second side 22 of the mounting body 20 to communicate the interior cavity of the mounting body 20 with an exterior thereof. Therefore, the coupling head 30 can be longitudinally moved with respect to the mounting head 20 via the guiding slot 26, which is aligned with and parallel to the barrel axis of the firearm. In particular, the guiding slot 26 has a predetermined length to define two ends, wherein when the coupling head 20 is slid at one end of the guiding slot 26, the coupling head 20 is retained in the releasing position, and when the coupling head 20 is slid at another end of the guiding slot 26, the coupling head 20 is retained in the securing position. In other words, the length of the guiding slot 20 is corresponding to a distance of the mounting slot 10 between the enlarged slot portion 11 and the narrower slot portion 12. It is worth mentioning that a width of the guiding slot 26 is slightly larger than a size of the neck portion 33 of the coupling head 30 and is smaller than a size of each of the retention portion 32 and the head portion 31 of the coupling head 30. A distance between the retention portion 32 and the head portion 31 of the coupling head 30 is larger than a depth of the guiding slot 26, i.e. the thickness of the bottom wall of the mounting body 10.

Figure 6:
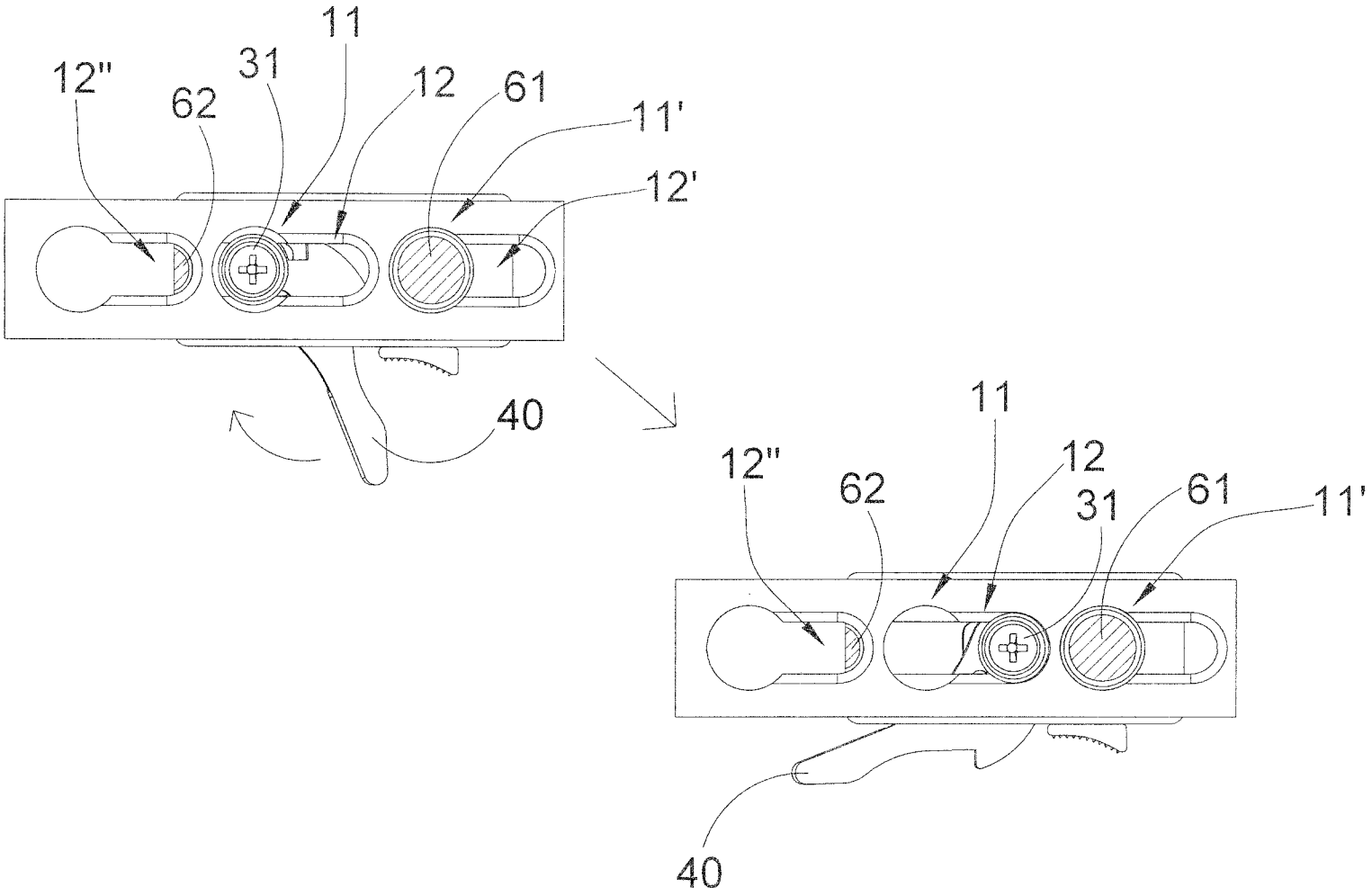
FIG. 6 is a bottom sectional view of the KeyMod quick mounting arrangement according to the above preferred embodiment of the present invention, illustrating the mounting operation of the arrangement to the KeyMod mounting slot.

According to the preferred embodiment, the coupling head 30 not only longitudinally moves with respect to the mounting head 20 but also vertically moves with respect to the mounting head 20 to adjust a distance between the head portion 31 of the coupling head 30 and the second side 22 of the mounting body 20, as shown in FIGS. 5 and 6. In particular, when the coupling head 30 is moved in the securing position, the head portion 31 of the coupling head 30 is lifted toward the second side 22 of the mounting body 20, such that a surrounding wall of the mounting slot 10 around the narrower slot portion 12 thereof will be sandwiched between the head portion 31 of the coupling head 30 and the second side 22 of the mounting body 20 so as to lock up the accessory at the firearm.

In particular, the mounting body 20 further has an elongated sliding channel 27 inclinedly formed at the mounting body 20, wherein the coupling head 30 is guided to slide at the sliding channel 27 to move the head portion 31 of the coupling head 30 toward the second side 22 of the mounting head 20 for gradually minimizing the distance between the head portion 31 of the coupling head 30 and the second side 22 of the mounting head 20 when the head portion 31 of the coupling head 30 is moved from the releasing position to the securing position. In other words, when the head portion 31 of the coupling head 30 is moved from the releasing position to the securing position, the head portion 31 of the coupling head 30 is concurrently moved toward the second side 22 of the mounting body 20.

As shown in FIG. 4, the sliding channel 27 is a through slot longitudinally and inclinedly formed at one of the sidewalls 23 of the mounting body 20 between the first and second sides 21, 22 thereof. Preferably, the sliding channel 27 is extended at 4 degrees with respect to the horizontal level. It is appreciated that the sliding channel 27 can be formed at one of the front or rear wall 24, 25 of the mounting body 20. The length of the sliding channel 27 must be equal or longer than the length of the guiding slot 26 to ensure the coupling head 20 to be moved between the releasing position and the securing position. It is worth mentioning that the guiding slot 26 is arranged to guide the longitudinally sliding movement of the coupling head 30 between the releasing position and the securing position. The sliding channel 27 is arranged to guide the vertical movement of the coupling head 30 to adjust the distance between the head portion 31 of the coupling head 30 and the second side 22 of the mounting head 20.

The arrangement of the present invention further comprises an actuating member 40 for manually moving the coupling head 20 between the releasing position and the securing position. The actuating member 40 is movably coupled at the mounting body 20 to drive the coupling head 20 to move. In particular, the actuating member 40 is extended from the coupling head 20 to engage with the sliding channel 27, such that when the actuating member 40 is moved at the sliding channel 27, the coupling head 20 is driven not only to longitudinally slide along the guiding slot 26 but also to vertically move via the sliding channel 27.

Figure 1:
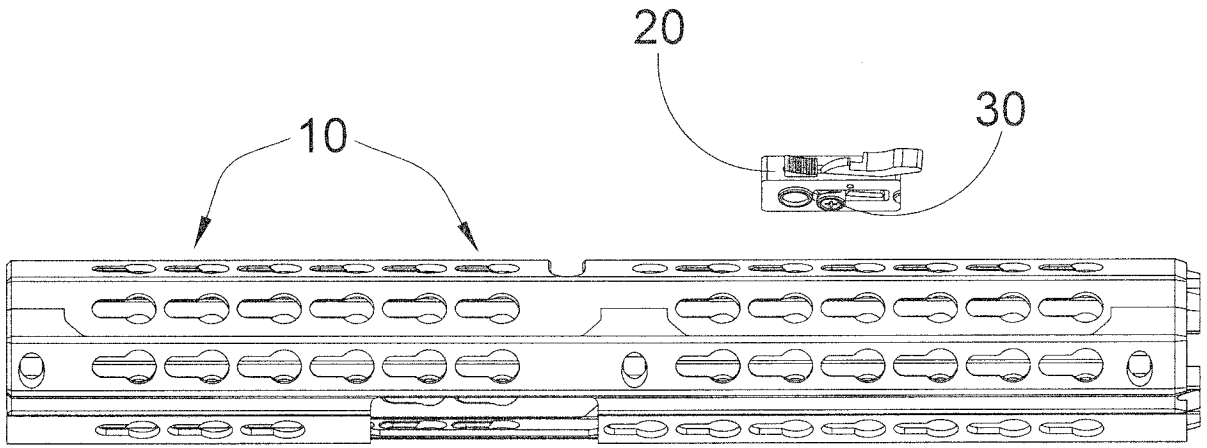
FIG. 1 is a perspective view of a KeyMod quick mounting arrangement according to a preferred embodiment of the present invention.
Figure 2:
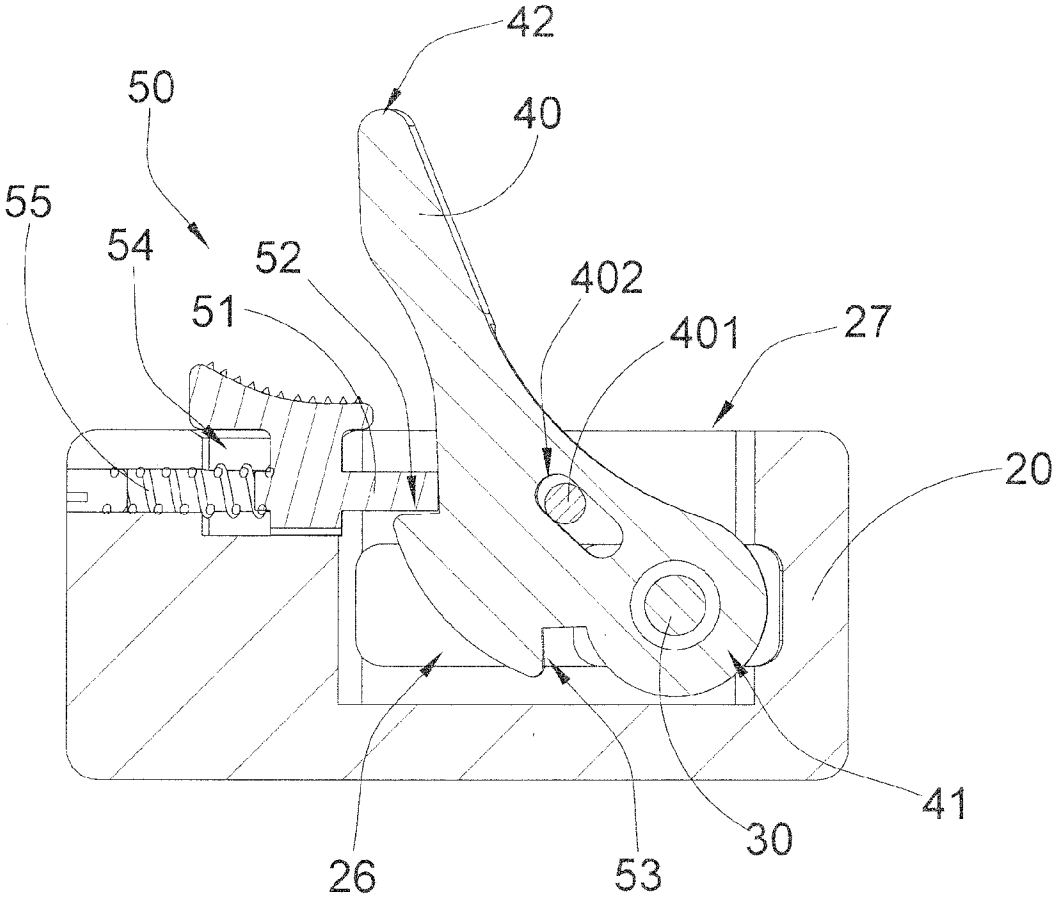
FIG. 2 is a bottom view of the KeyMod quick mounting arrangement according to the above preferred embodiment of the present invention, illustrating the coupling head in a releasing position.

As shown in FIGS. 2 to 4, the actuating member 40 is pivotally coupled at the mounting body 20 to define a pivot point 401 thereat. The actuating member 40 has a driving end 41 extended into the interior cavity of the mounting body 20 to couple at the coupling head 30 and an actuating end 42 extended out of the sidewall 23 of the mounting body 20 through the sliding channel 27. The driving end 41 of the actuating member 40 is rotatably coupled at the retention portion 32 of the coupling head 30.

The pivot point 401 of the actuating member 40 is defined between the driving end 41 and the actuating end 42. Therefore, by actuating the actuating end 42 of the actuating member 40, the driving end 41 of the actuating member 40 is pivotally moved to drive the coupling head 30 between the releasing position and the securing position. It is worth mentioning that the actuating member 40 has an elongated pivot slot 402 formed thereat, wherein a pivot axle affixed at the pivot point 401 is engaged with the pivot slot 402, so as to enable the driving end 41 of the actuating member 40 to move the coupling head 30 in a linear direction along the guiding slot 26 the pivotal movement of the actuating member 40.

It is worth mentioning that during the pivotal movement of the actuating member 40, the coupling head 20 is guided to longitudinally slide along the guiding slot 26. At the same time, the pivotal movement of the actuating member 40 is guided by the sliding channel 27 in order to vertically move the head portion 31 of the coupling head 30 toward the second side 22 of the mounting head 20 when the coupling head 20 is guided to longitudinally slide along the guiding slot 26 from the releasing position to the securing position. In other words, one single actuating action of the actuating member 40 will move the head portion 31 of the coupling head 30 being slid to the narrower slot portion 12 of the mounting slot 10 and being moved toward the second side 22 of the mounting head 20 at the same time for securing the accessory at the firearm.

As shown in FIGS. 2 to 4, the arrangement further comprises a locker unit 50 provided at the mounting body 20 for locking the coupling head 30 in the securing position. According to the preferred embodiment, the locker unit 50 is also arranged to lock up the coupling head 30 in the releasing position.

According to the preferred embodiment, the locker unit 50 comprises a locking latch 51, and first and second locking edges 52, 53 defined at the actuating member 40. When the locking latch 51 is engaged with the first locking edge 52, the coupling head 30 is locked in the releasing position, as shown in FIG. 2. When the locking latch 51 is engaged with the second locking edge 52, the coupling head 30 is locked in the securing position, as shown in FIG. 3.

In particular, when the actuating member 40 is pivotally moved to drive the coupling head 30 in the releasing position, the actuating member 40 is moved in a position that the locking latch 51 is engaged with the first locking edge 52. Likewise, when the actuating member 40 is pivotally moved to drive the coupling head 30 in the securing position, the actuating member 40 is moved in a position that the locking latch 51 is engaged with the second locking edge 53. As a result, the coupling head 30 will be locked and stationary in each of the releasing position and the securing position. It is worth mentioning that after the locking latch 51 of the locker unit 50 is actuated to release the coupling head 30 in the releasing position, the coupling head 30 is allowed to move to the securing position that the head portion 31 of the coupling head 30 is slid to the narrower slot portion 12 of the mounting slot 10 for securing the accessory at the firearm.

As shown in FIG. 4, the locker unit 50 further has an elongated locking slot 54 formed at the sidewall 23 of the mounting body 20 and is integrally extended from the sliding channel 27 end-to-end, wherein the locking latch 51 is slidably engaged at the locking slot 54. Preferably, the locking slot 54 is a horizontal through slot to communicate with the sliding channel 27.

When the locking latch 51 is slid along the locking slot 51 toward the sliding channel 27, the locking latch 51 is engaged with either the first or second locking edges 52, 53 at the actuating member 40. When the locking latch 51 is slid along the locking slot 51 away from the sliding channel 27, the locking latch 51 is disengaged with either the first or second locking edges 52, 53 so as to enable the pivotal movement of the actuating member 40.

The locker unit 50 further comprises a resilient element 55 supported within the interior cavity of the mounting body 20 for applying an urging force against the locking latch 51. The resilient element 55, according to the preferred embodiment, is a compression spring having two ends biased against the locking latch 51 and an inner wall of the interior cavity of the mounting body 20 to push the locking latch 51 toward the sliding channel 27 along the locking slot 51, so as to ensure the locking latch 51 to be engaged with either the first or second locking edges 52, 53 at the actuating member 40. Therefore, the user must intentionally slide the locking latch 51 along the locking slot 54 to move the locking latch 51 away from the sliding channel 27 by overcoming the spring force of the resilient element 55 in order to disengage the locking latch 51 with either the first or second locking edges 52, 53.

Figure 7A:
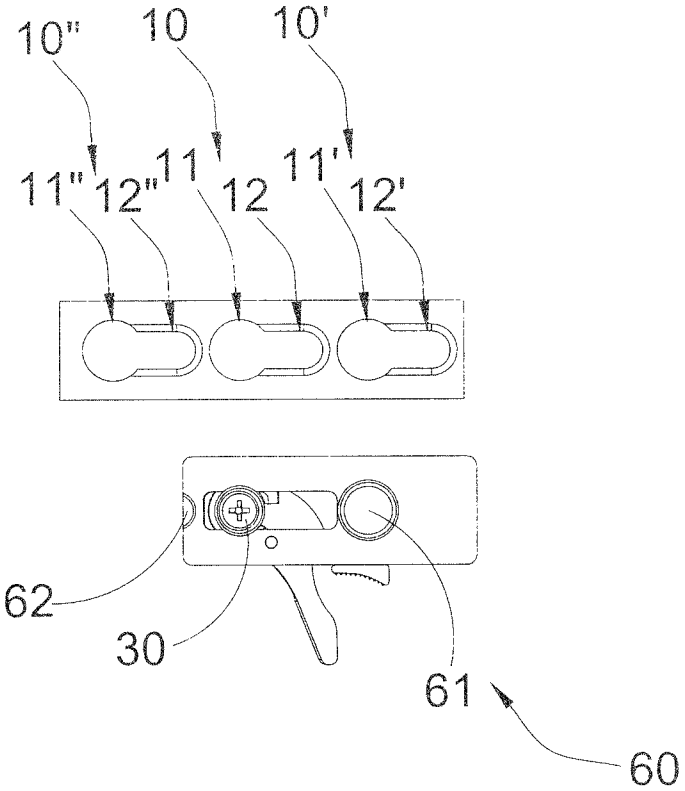
FIGS. 7A to 7G illustrates different configurations of the first and second positioning members incorporating with the coupling head of the KeyMod quick mounting arrangement according to the above preferred embodiment of the present invention.
Figure 7:
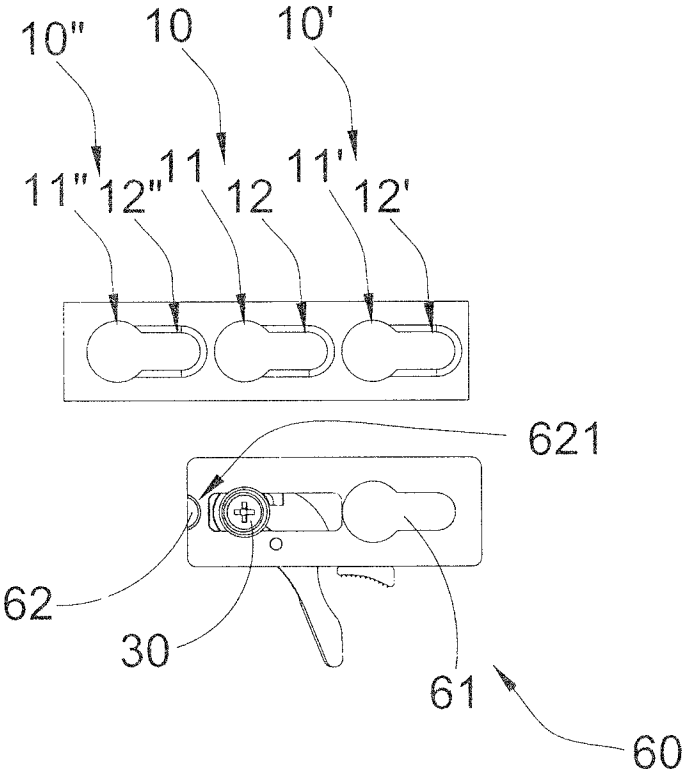
FIG. 7 illustrates the first and second positioning members incorporating with the coupling head of the KeyMod quick mounting arrangement according to the above preferred embodiment of the present invention.

As shown in FIG. 7, the arrangement further comprises a positioning unit 60 for ensuring the corrected alignment between the accessory and the firearm and for preventing any unwanted longitudinal and/or rotational movement of the accessory with respect to the firearm after the mounting body 20 is mounted to the firearm.

The positioning unit 60 comprises a first positioning member 61 protruded from the second side 22 of the mounting body 20 at a position adjacent to the coupling head 30, wherein the positioning member 61 is arranged for engaging with a second mounting slot 10' adjacent to the mounting slot 10 where the coupling head 30 is engaged therewith.

The positioning unit 60 further comprises a second positioning member 62 protruded from the second side 22 of the mounting body 20 at a position adjacent to the coupling head 30, wherein the second positioning member 62 is arranged for engaging with an edge of a third mounting slot 10" adjacent to the mounting slot 10 where the coupling head 30 is engaged therewith.

According to the preferred embodiment, the first and second positioning members 61, 62 are integrally protruded from the second side 22 of the mounting body 20 and are aligned at a centerline of the guiding slot 26, wherein the coupling head 30 is positioned between the two positioning members 61, 62. In particular, the first and second positioning members 61, 62 are arranged to engage with the second and third mounting slots 10', 10" respectively, wherein the mounting slot 10 for the coupling head 30 is located between the second and third mounting slots 10', 10".

Figure 7C:
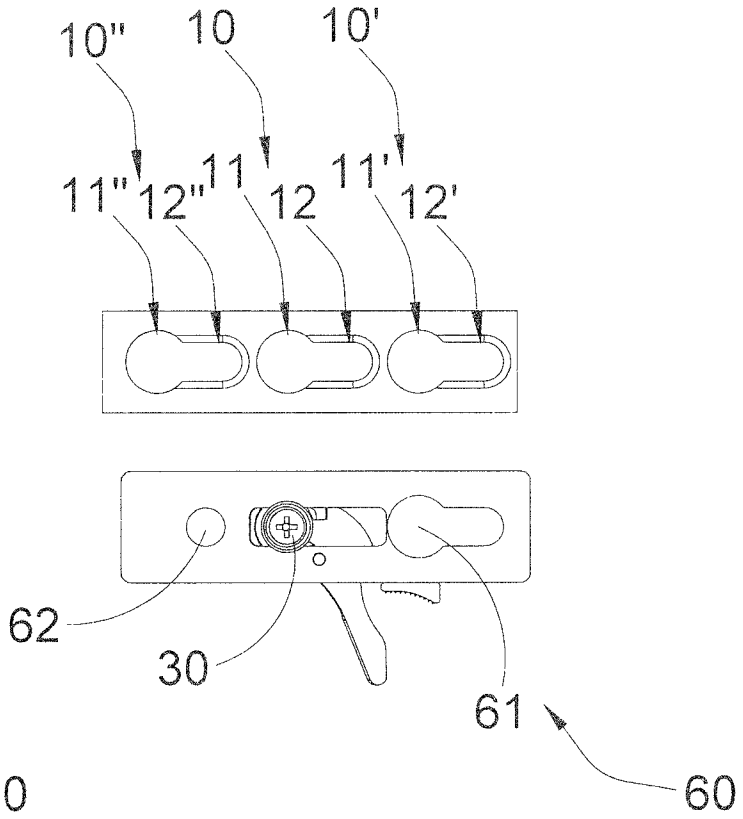
Figure 7B:
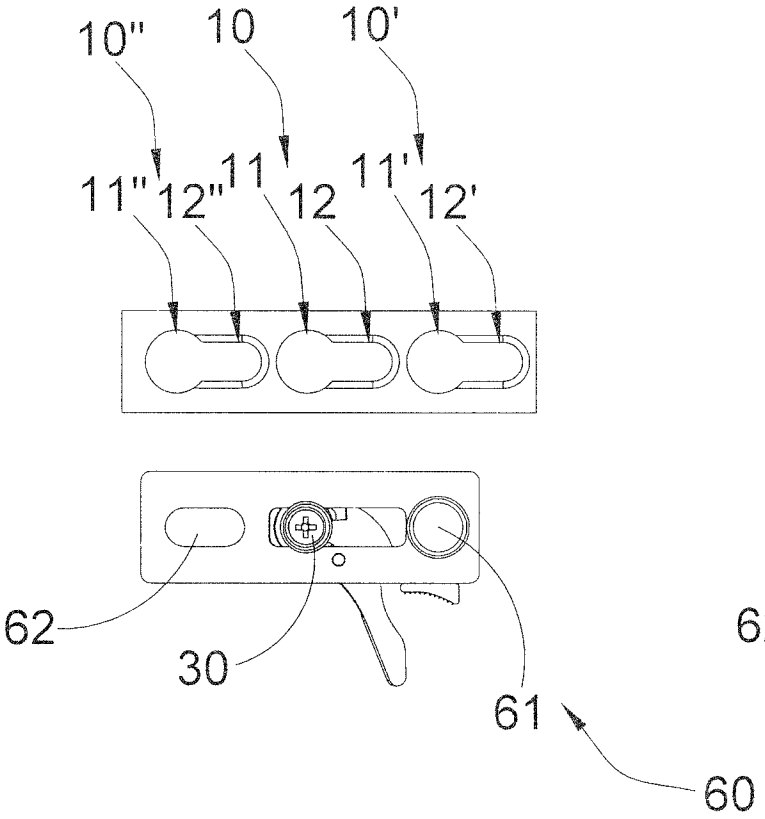
Figure 7E:
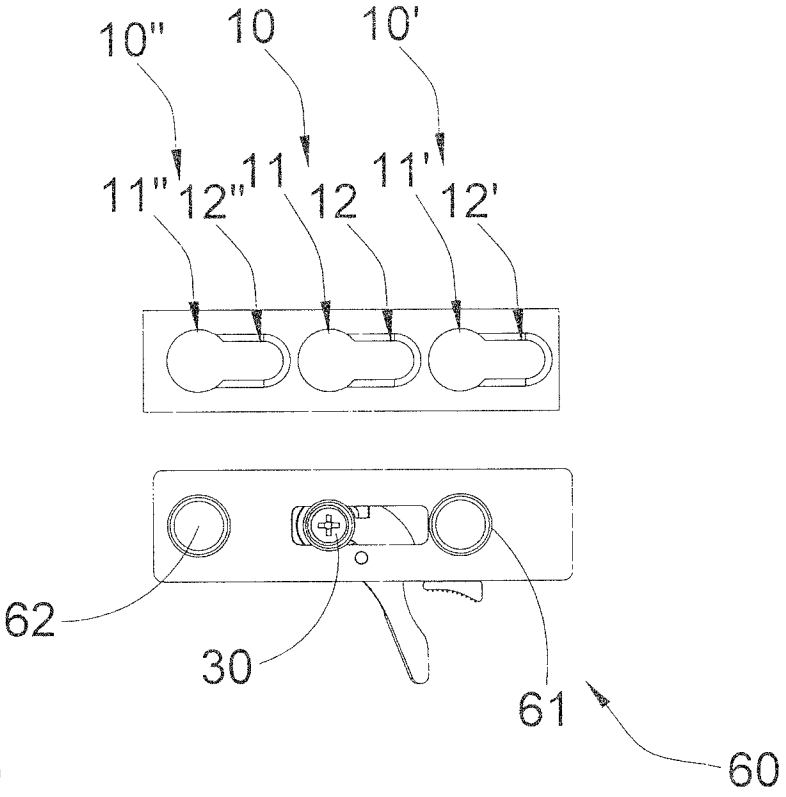
Figure 7D:
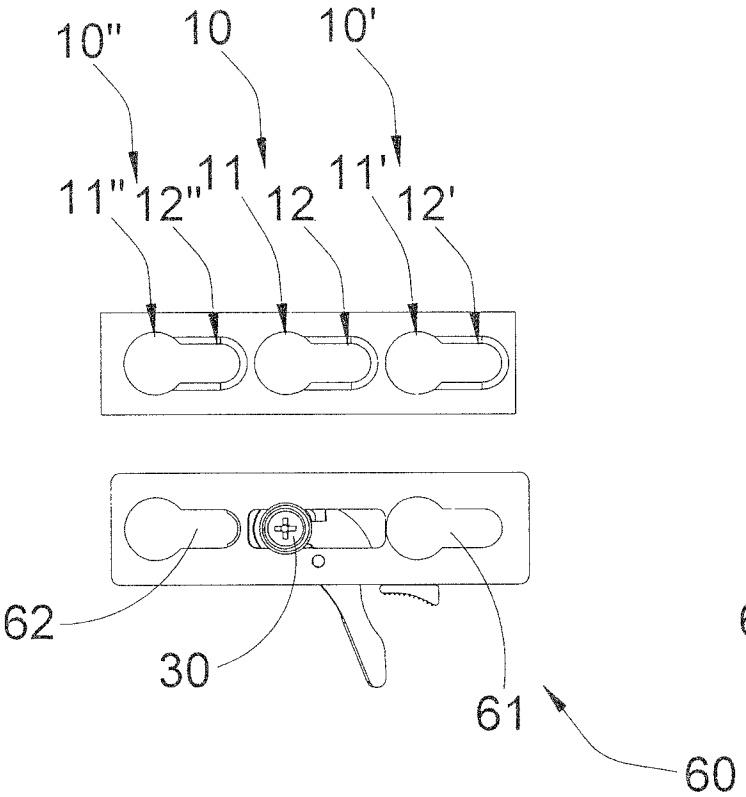

Preferably, the first positioning member 61 is sized and shaped with a keyhole configuration to match with the size and shape of the second mounting slot 10', as shown in FIG. 7. The second positioning member 62 has a curved engaging edge 621 adapted for engaging with the edge of the third mounting slot 10" at the narrower slot portion 12" thereof, as shown in FIG. 7. Alternatively, the first and second positioning members 61, 62 can be configured with different shapes corresponding to the shapes of the second and third mounting slots 10', 10", as shown in FIGS. 7A to 7G. For example, the size and shape of the first positioning member 61 can be configured to match with the enlarged slot portion 11' of the second mounting slot 10', as shown in FIGS. 7A, 7B, and 7E. The size and shape of the second positioning member 62 can be configured to match with the narrower slot portion 12" of the third mounting slot 10", as shown in FIG. 7B. The size and shape of the second positioning member 62 can be configured to match with the diameter size of the narrower slot portion 12" of the third mounting slot 10", as shown in FIG. 7C. Likewise, the sizes and shapes of the first and second positioning members 61, 62 are configured to have a keyhole configuration to match with the sizes and shapes of the second and third mounting slots 10', 10", as shown in FIG. 7D. Or, the size and shape of the second positioning member 62 can be configured to match with the diameter size of the enlarged slot portion 11" of the third mounting slot 10", as shown in FIG. 7E.

Figure 7G:
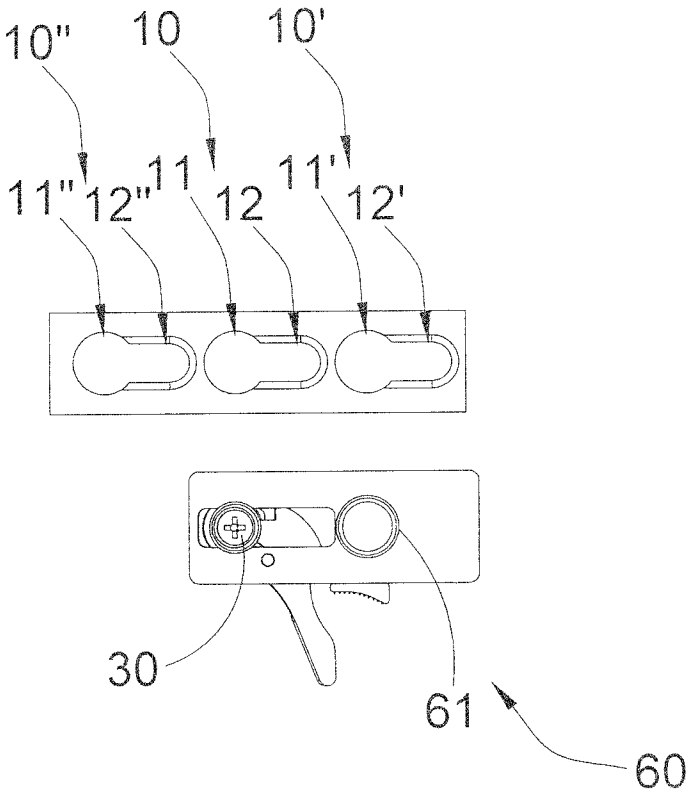
Figure 7F:
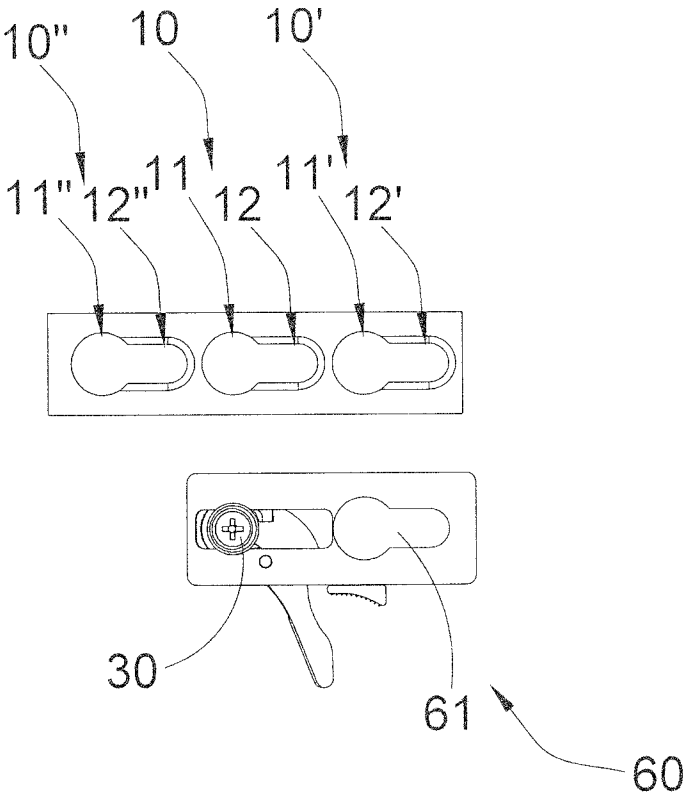

It is worth mentioning that only one positioning member 61 can be used to incorporate with the coupling head 30 while the second positioning member 62 could be optional. For example, the first positioning member 61 can be formed in keyhole configuration to incorporate with the coupling head 30, as shown in FIG. 7F, or the first positioning member 61 can be formed to match with the enlarged slot portion 11' of the second mounting slot 10' in order to incorporate with the coupling head 30, as shown in FIG. 7G.

Preferably, both the first and second positioning members 61, 62 are used to incorporate with the coupling head 30, such that the arrangement of the present invention provides a three-point support to prevent any unwanted longitudinal and/or rotational (twisting) movement of the accessory with respect to the firearm after the mounting body 20 is mounted to the firearm.

It is worth mentioning that since the coupling head 30 is locked in the releasing position, the first and second positioning members 61, 62 are automatically aligned with the second and third mounting slots 10', 10" respectively. In other words, in the releasing position, the distance between the coupling head 30 and the first positioning member 61, and the distance between the coupling head 30 and the second positioning member 62 will not be altered. As a result, once the head portion 31 of the coupling head 30 is aligned at the enlarged slot portion 11 of the mounting slot 10, the first and second positioning members 61, 62 will align with the second and third mounting slots 10', 10" respectively. This is the reason why the coupling head 30 should be locked and stationary in the releasing position.

Figure 8:
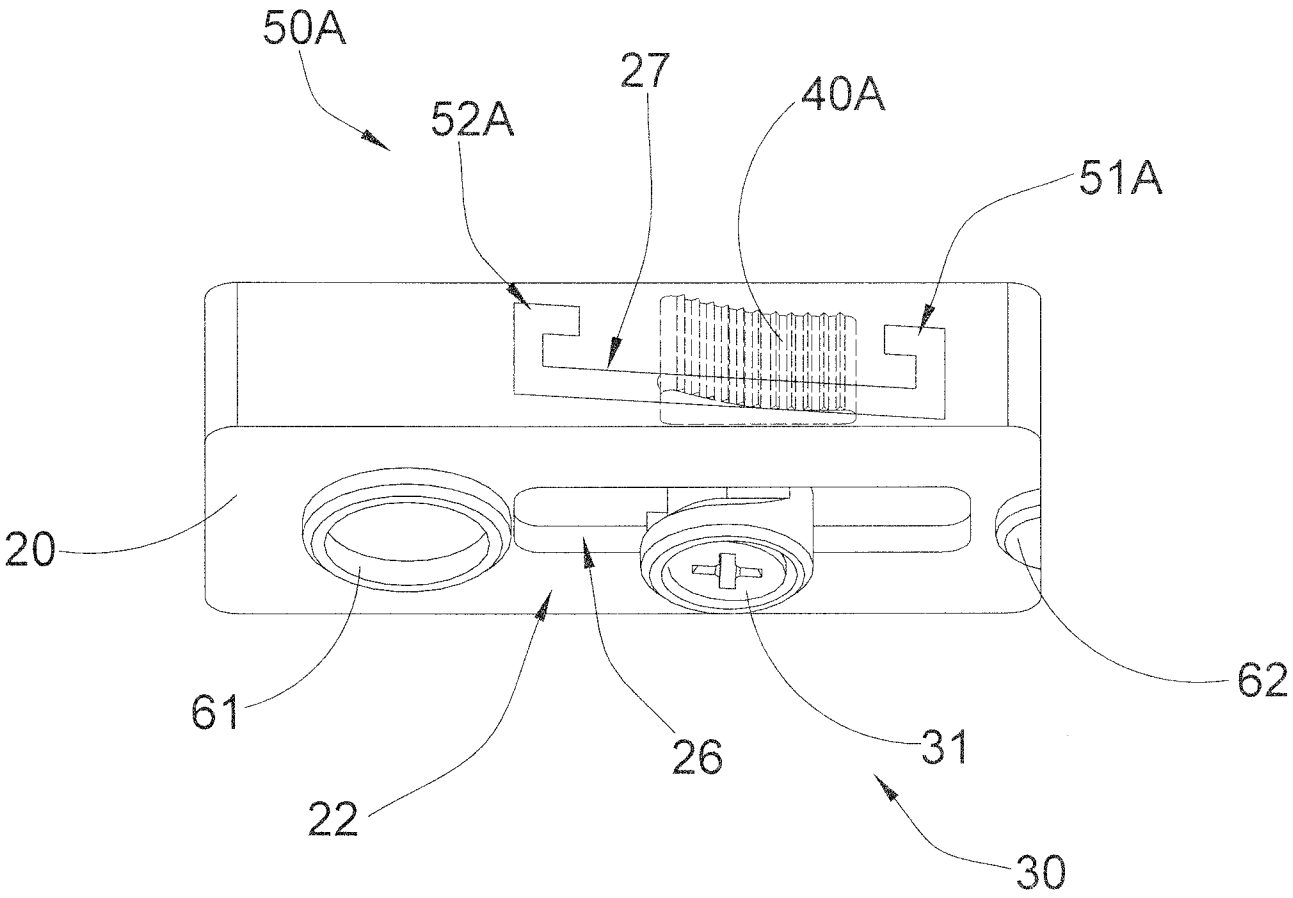
FIG. 8 illustrates a first alternative mode of the KeyMod quick mounting arrangement according to the above preferred embodiment of the present invention.
Figure 9:
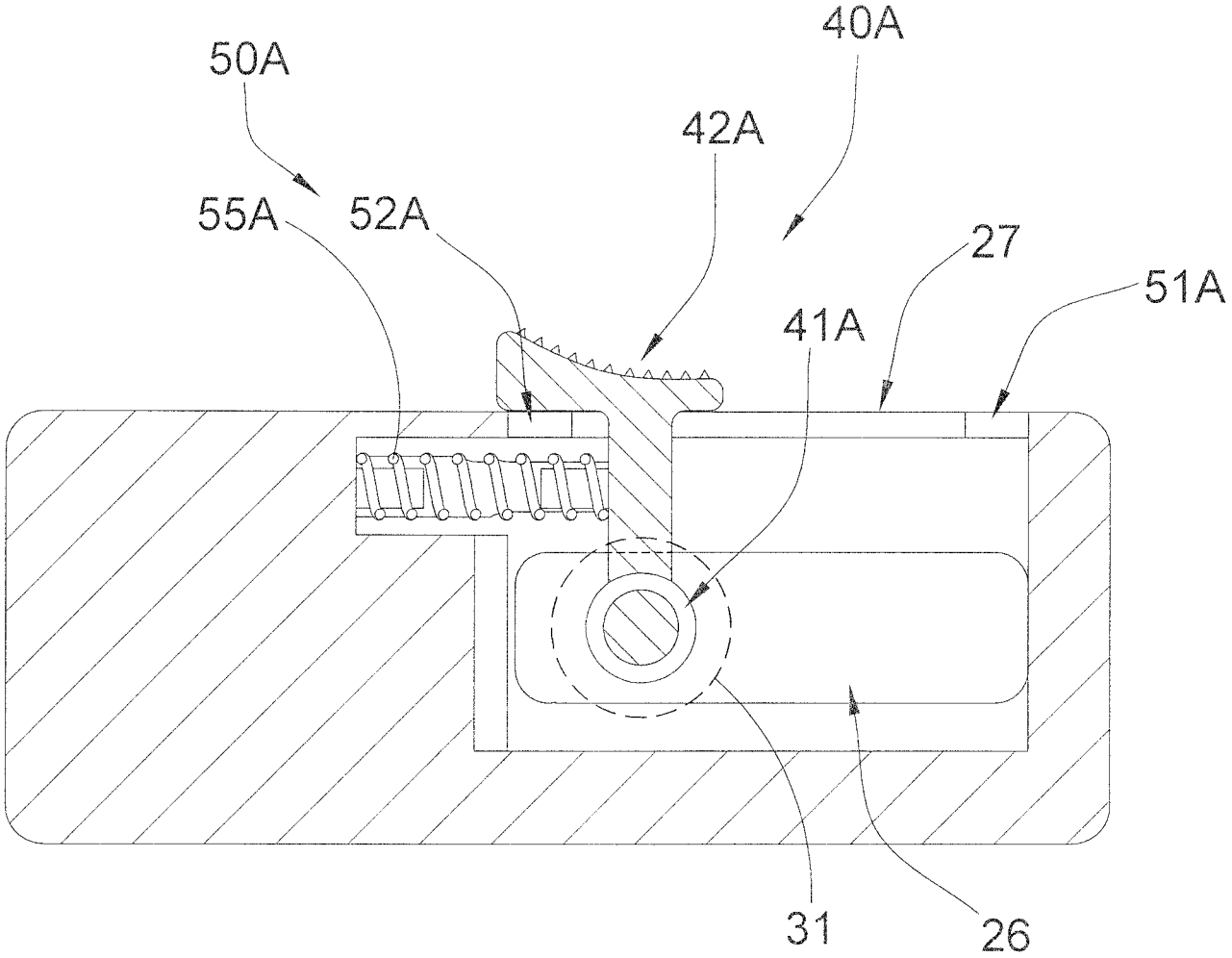
FIG. 9 is a sectional view of the first alternative mode of the KeyMod quick mounting arrangement according to the above preferred embodiment of the present invention.

FIGS. 8 and 9 illustrate a first alternative mode of the arrangement, wherein the actuating member 40A is slidably coupled at the mounting body 20 at the sliding channel 27. Accordingly, the actuating member 40A has a driving end 41A extended into the interior cavity of the mounting body 20 to couple at the coupling head 30 and an actuating end 42A extended out of the sidewall 23 of the mounting body 20 through the sliding channel 27. The driving end 41A of the actuating member 40A is affixed at the coupling head 30. Therefore, by actuating the actuating end 42A of the actuating member 40A to slide the actuating member 40A along the sliding channel 27, the driving end 41A of the actuating member 40A is correspondingly moved to drive the coupling head 30 between the releasing position and the securing position. In other words, the coupling head 30 is guided to move from the releasing position to the securing position in order to move the head portion 31 of the coupling head 30 toward the bottom side 22 of the mounting body 20 at the same tune. It is worth mentioning that one single actuating action of the actuating member 40A will move the head portion 31 of the coupling head 30 being slid to the narrower slot portion 12 of the mounting slot 10 and being moved toward the second side 22 of the mounting head 20 at the same time for securing the accessory at the firearm.

It is appreciated that the actuating member 40A can be extended out of the interior cavity of the mounting body 20 through the front wall thereof, wherein the actuating member 40A can be pulled to move the coupling head 30 from the releasing position to the securing position and can be pushed to move the coupling head back to the releasing position from the securing position. Likewise, the actuating member 40A can be extended out of the interior cavity of the mounting body 20 through the rear wall thereof, wherein the actuating member 40A can be pushed to move the coupling head 30 from the releasing position to the securing position and can be pulled to move the coupling head back to the releasing position from the securing position. It is worth mentioning that, for the configuration of the actuating member 40A at the front or rear side of the mounting body 20, the sliding channel 27 can be formed as a rail supported in the interior cavity of the mounting to guide the head portion 31 of the coupling head 30 moving toward the bottom side 22 of the mounting body 20 when the coupling head 30 is moving in the securing position.

Furthermore, the locker unit 50A has first and second locking slots 51A, 52A transversely extended from two ends of the sliding channel 27 to form a U-shaped configuration. When the actuating member 40A is slid from the sliding channel 27 to the first locking slot 51A, the coupling head 30 is locked in the releasing position, and when the actuating member 40A is slid from the sliding channel 27 to the second locking slot 52A, the coupling head 30 is locked in the securing position.

The locker unit 50A further comprises a resilient element 55A supported within the interior cavity of the mounting body 20 for applying an urging force against the actuating member 40A. The resilient element 55A, according to the preferred embodiment, is a compression spring having two ends biased against the actuating member 40A and an inner wall of the interior cavity of the mounting body 20 to push the actuating member 40A toward the first locking slot 51A, so as to ensure the actuating member 40A to be engaged with the first locking slot 51A. Therefore, the user must intentionally slide the actuating member 40A along the sliding channel 27 from the first locking slot 51A by overcoming the spring force of the resilient element 55A in order to push the actuating member 40A toward the second locking slot 52A.

Figure 10:
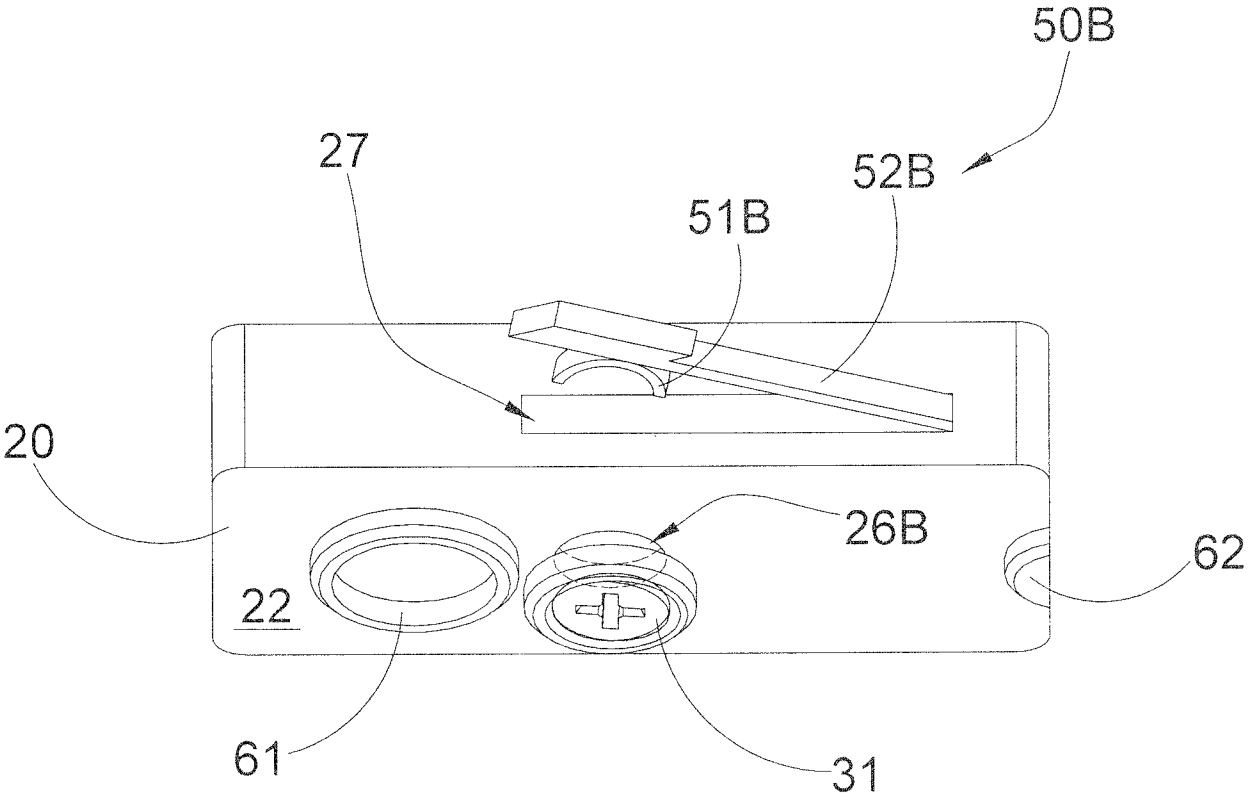
FIG. 10 illustrates a second alternative mode of the KeyMod quick mounting arrangement according to the above preferred embodiment of the present invention.
Figure 11:
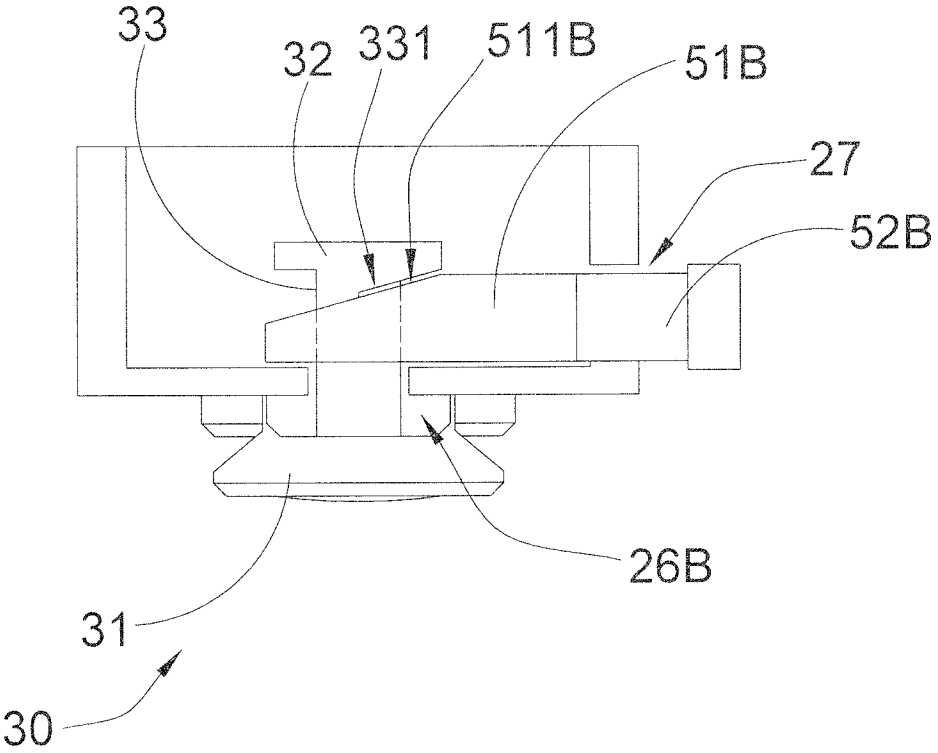
FIG. 11 is a sectional view of the second alternative mode of the KeyMod quick mounting arrangement according to the above preferred embodiment of the present invention.

FIGS. 10 and 11 illustrates a second alternative of the arrangement, wherein the guiding slot 26B is modified to have a circular hole configuration formed at the bottom side 22 of the mounting body 20. The diameter of the guiding slot 26B is slightly larger than a size of the neck portion 33 of the coupling head 30 and is smaller than a size of each of the retention portion 32 and the head portion 31 of the coupling head 30. Therefore, the coupling head 30 can only moved vertically at the guiding slot 26B but cannot move longitudinally with respect to the mounting head 20.

Accordingly, when the head portion 31 of the coupling head 30 is moved between the releasing position and the securing position, the mounting body 20 is correspondingly moved at the same direction. In other words, the coupling head 30 is locked in the releasing position via the guiding slot 26B to prevent the coupling head 30 being slid with respect to the mounting body 20.

The locker unit 50B is provided at the mounting body 20 for locking the coupling head 30 in the securing position. The locker unit 50B comprises a locking arm 52B pivotally coupled at the mounting body 20 and a locking latch 51B extended from the locking arm 52B to couple at the coupling head 30 in order to lock up the coupling head 30 in the securing position and to move the head portion 31 of the coupling 30 toward the bottom side 22 of the mounting body 20 at the same time.

As shown in FIG. 10, the locking arm 52B has a pivot end pivotally coupled at the mounting body 20 and an opposed movable end, wherein the locking arm 50B is pivotally movable at the sliding channel 27. The locking latch 51B generally has a U-shaped configuration integrally extended from the locking arm 52B, wherein when the movable end of the locking arm 5B is actuated, the locking latch 51B is extended into the interior cavity of the mounting body 20 through the sliding channel 27 and is engaged with the neck portion 33 of the coupling head 30 so as to move the head portion 31 of the coupling 30 toward the bottom side 22 of the mounting body 20. It is worth mentioning that the locking latch 51B is coupled at the coupling head 30 only when the coupling head 30 is moved in the securing position. Preferably, a first slanted surface 331 is formed at the neck portion 33 of the coupling head 30 and a second slanted surface 511B is formed at the locking latch 51B, such that when the locking latch 51B is engaged with the neck portion 33 of the coupling head 30, the second slanted surface 511B is engaged with the first slanted surface 331 to move the head portion 31 of the coupling 30 toward the bottom side 22 of the mounting body 20. Accordingly, the sliding channel 27 in this alternative can be an inclined channel or a horizontal channel formed at the sidewall 23 of the mounting body 20.

The present invention further provides a method of detachably mounting the accessory at the firearm via the arrangement of the present invention. For the configuration of the coupling head 30 capable of longitudinally moving with respect to the mounting body 20 via the guiding slot 26, the method comprises the following steps.

(1) Dispose the head portion 31 of the coupling head 30 at the enlarged slot portion 11 of the mounting slot 10. Accordingly, the coupling head 30 is locked and stationary at the releasing position by the locker unit 50, such that the user is able to easily align the head portion 31 of the coupling head 30 with the enlarged slot portion 11 of the mounting slot 10. At the same time, the first and second positioning members 61, 62 are automatically aligned with the second and third mounting slots 10', 10" respectively.

(2) Slidably move the head portion 31 of the coupling head 30 from the enlarged slot portion 11 of the mounting slot 10 to the narrower slot portion 12 thereof so as to move the coupling head 30 from the releasing position to the securing position. It is worth mentioning that the mounting body 20 is stationary when the coupling head 30 is moved from the releasing position to the securing position along the guiding slot 26.

Accordingly, the coupling head 30 is moved by the actuating member 40. Preferably, when the actuating member 40 is pivotally actuated, the head portion 31 of the coupling head 30 not only moves to the narrower slot portion 12 of the mounting slot 10 but also moves toward the bottom side 22 of the mounting body 20. Therefore, the surrounding wall around the mounting slot 10 is clamped between the head portion 31 of the coupling head 30 and the bottom side 22 of the mounting body 20.

Alternatively, the coupling head 30 is moved by the actuating member 40A, wherein the actuating member 40A is slid along the sliding channel 27 to move the coupling head 30 between the releasing position and the securing position.

(3) Lock up the coupling head 30 in the securing position via the locker unit 50. As a result, the accessory at first side 21 of the mounting body 20 can be securely mounted to the firearm.

In order to detach the accessory from the firearm, the user is able to unlock the coupling head 30 at the securing position via the locker unit 50 and move the head portion 31 of the coupling head 30 back to the enlarged slot portion 11 of the mounting slot 10 from the narrower slot portion 12 thereof. Therefore, the mounting body 20 can be detached from the firearm once the head portion 31 of the coupling head 30 is disengaged from the enlarged slot portion 11 of the mounting slot 10.

The locking/unlocking operation of the arrangement comprises the following steps.

(A) Unlock the coupling head 30 in the releasing position to enable the coupling head 30 to move from the releasing position to the securing position. Accordingly, the coupling head 30 is normally locked up in the releasing position. In particular, the locking latch 51 is engaged with the first locking edge 52 at the actuating member 40 to retain the coupling head 30 in a stationary manner. Therefore, the head portion 31 of the coupling head 30 can be easily disposed at the enlarged slot portion 11 of the mounting slot 10.

The locking latch 51 is moved until the locking latch 51 is disengaged with the first locking edge 52 at the actuating member 40. Once the engagement between the locking latch 51 and the first locking edge 52 is released, the coupling head 30 can be moved from the releasing position to the securing position via the actuating arm 40.

Alternatively, the actuating member 40A is engaged with the first locking slot 51A to retain the coupling head 30 in a stationary manner and to lock up the coupling head 30 in the releasing position. The actuating member 40A is moved from the first locking slot 51A to the sliding channel 27 in order to unlock the coupling head 30 in the releasing position, such that the coupling head 30 can be moved from the releasing position to the securing position via the actuating arm 40A.

(B) Slidably move the head portion 31 of the coupling head 30 from the enlarged slot portion 11 of the mounting slot 10 to the narrower slot portion 12 thereof so as to move the coupling head 30 from the releasing position to the securing position.

(C) Lock up the coupling head 30 in the securing position. Accordingly, the locking latch 51 is engaged with the second locking edge 53 at the actuating member 40 to lock up the coupling head 30 in the securing position. It is worth mentioning that via the spring force of the resilient element 55, the locking latch 51 is pushed to automatically engage with the second locking edge 53, so as to ensure the coupling head 30 to be locked in the securing position.

In order to unlock the coupling head 30 in the securing position, the locking latch 51 is moved until the locking latch 51 is disengaged with the second locking edge 53. Therefore, the coupling head 30 can be moved back in the releasing position via the actuating member 40. Likewise, the spring force of the resilient element 55 will push the locking latch 51 to automatically engage with the first locking edge 52, so as to ensure the coupling head 30 to be locked in the releasing position.

Alternatively, when the actuating member 40A is slid from the sliding channel 27 to the second locking slot 52A, the coupling head 30 is locked in the securing position. In order to unlock the coupling head 30 in the securing position, the actuating member 40A is moved from the second locking slot 52A back to the sliding channel 27, so as to enable the coupling head 30 to be moved back to the releasing position.

For the configuration of the coupling head 30 capable of only moving in a vertical direction with respect to the mounting body 20 via the guiding slot 26B, the method comprises the following steps.

(1) Dispose the head portion 31 of the coupling head 30 at the enlarged slot portion 11 of the mounting slot 10.

(2) Slidably move the head portion 31 of the coupling head 30 from the enlarged slot portion 11 of the mounting slot 10 to the narrower slot portion 12 thereof so as to move the coupling head 30 from the releasing position to the securing position. It is worth mentioning that the mounting body 20 is moved to drive the coupling head 30 moving from the releasing position to the securing position.

Accordingly, when the head portion 31 of the coupling head 30 is moved in the securing position, the first and second positioning members 61, 62 are automatically aligned with the second and third mounting slots 10', 10" respectively.

(3) Lock up the coupling head 30 in the securing position via the locker unit 50. Accordingly, when the locking arm 5B is actuated, the locking latch 51B is driven to engage with the neck portion 33 of the coupling head 30 so as to lock up the coupling head 30 in the securing position and to move the head portion 31 of the coupling 30 toward the bottom side 22 of the mounting body 20 at the same time.

It is worth mentioning that the arrangement according to the preferred embodiment and their alternatives are interchangeable such that the user is able to detachably mount the accessory to the firearm. For example, the coupling head 30 can be moved by the actuating member 40 or the actuating member 40A while the coupling head 30 is locked by the locking latch 51B. The actuating member 40, 40A can be incorporated with any wall of the mounting body 20 except the first and second sides 21, 22 thereof.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A quick mounting arrangement for detachably coupling on a firearm having one or more mounting slots in which each mounting slot has a keyhole configuration to define an enlarged slot portion and a narrow slot portion, wherein said quick mounting arrangement comprises:

a mounting body having a first side, and an opposed second side;

a coupling head, which is movably extended from said mounting body between a releasing position and a securing position, having a head portion outwardly protruded from said second side of said mounting body, wherein said mounting body is arranged for stationary placing on the firearm when said coupling head is moved between said releasing position and said securing position, wherein in said releasing position, said head portion of said coupling head is disposed in the enlarged slot portion of the mounting slot, and in said securing position, said head portion of said coupling head is slid to the narrower slot portion of the mounting slot for securing said mounting body on the firearm, wherein said mounting body further has an elongated guiding slot formed at said second side of said mounting body, wherein said head portion of said coupling head is outwardly protruded from said second side of said mounting body through said guiding slot and is guided to slide at said guiding slot between said releasing position and said securing position, wherein said mounting body further has an elongated sliding channel inclinedly formed at said mounting body, wherein said coupling head is guided to slide at said sliding channel to move said head portion of said coupling head toward said second side of said mounting head for gradually minimizing a distance between said head portion of said coupling head and said second side of said mounting head when said head portion of said coupling head is moved from said releasing position to said securing position, wherein said sliding channel is inclinedly formed at one of sidewalls of said mounting body between said first and second sides thereof;

an actuating member pivotally coupled at said mounting body, wherein said actuating member has a driving end coupled at said coupling head and an actuating end arranged to pivotally drive said driving end to move said coupling head between said releasing position and said securing position, wherein said actuating end of said actuating member is extended out of said mounting body through said sliding channel, such that when said actuating member is pivotally moved at said sliding channel, said head portion of said coupling head is driven to move toward said second side of said mounting head from said releasing position to said securing position; and a locker unit provided at said mounting body for locking said coupling head in said releasing position and in said securing position, wherein said locker unit comprises a locking latch, and first and second locking edges defined at said actuating member, such that when said locking latch is engaged with said first locking edge, said coupling head is locked in said releasing position, and when said locking latch is engaged with said second locking edge, said coupling head is locked in said securing position.

2. A quick mounting arrangement, for detachably coupling on a firearm having one or more mounting slots in which each mounting slot has a keyhole configuration to define an enlarged slot portion and a narrow slot portion, wherein said quick mounting arrangement comprises:

a mounting body having a first side and an opposed second side;

a coupling head, which is movably extended from said mounting body between a releasing position and a securing position, having a head portion outwardly protruded from said second side of said mounting body;

an actuating member movably coupled at said mounting body to move said coupling head between said releasing position and said securing position, wherein in said releasing position, said head portion of said coupling head is disposed in the enlarged slot portion of the mounting slot, and in said securing position, said head portion of said coupling head is slid to the narrower slot portion of the mounting slot for securing said mounting body on the firearm; and a locker unit provided at said mounting body for locking said coupling head in said releasing position and in said securing position, wherein said locker unit comprises a locking latch, and first and second locking edges defined at said actuating member, such that when said locking latch is engaged with said first locking edge, said coupling head is locked in said releasing position, and when said locking latch is engaged with said second locking edge, said coupling head is locked in said securing position.

* * * * *